United States Patent [19]

Schlicht

[11] 4,073,356

[45] Feb. 14, 1978

[54] MOTORIZED SKATEBOARD

[76] Inventor: Dennis Roman Schlicht, 4231 ½ Ocean Blvd., San Diego, Calif. 92109

[21] Appl. No.: 761,682

[22] Filed: Jan. 24, 1977

[51] Int. Cl.[2] ..... A63C 17/12

[52] U.S. Cl. ..... 180/1 G; 180/15; 180/74; 280/11.11 E; 280/87.04 A

[58] Field of Search ..... 280/11.11 E, 11.11 R, 280/87.04 A, 87.04 R; 180/1 G, 15, 16, 21, 74

[56] References Cited

U.S. PATENT DOCUMENTS

| | | | |
|---|---|---|---|
| 823,385 | 6/1906 | Beauford | 280/11.11 E |
| 854,299 | 5/1907 | Matson | 280/11.11 E |
| 1,672,700 | 6/1928 | Vass | 280/11.11 E |
| 1,694,671 | 12/1928 | Rodelli | 280/11.11 E |
| 1,784,761 | 12/1930 | Smith | 280/11.11 R |
| 2,239,122 | 4/1941 | Stokes | 180/1 G |
| 2,257,653 | 9/1941 | Russell | 180/1 G |
| 2,544,996 | 3/1951 | Kander | 280/87.04 R |
| 3,035,854 | 5/1962 | Johnston | 280/11.11 R |
| 3,224,785 | 12/1965 | Stevenson | 180/1 G |

FOREIGN PATENT DOCUMENTS

| | | | |
|---|---|---|---|
| 835,558 | 4/1952 | Germany | 280/11.11 E |

OTHER PUBLICATIONS

"41st Avenue Skateboards" Skateboarder Magazine, vol. 2, No. 6 Aug. 1976.

*Primary Examiner*—David M. Mitchell
*Attorney, Agent, or Firm*—Brown & Martin

[57] ABSTRACT

A skateboard having a fifth wheel attached to the board and coupled to a motor mounted on the board for driving the board in response to operation of the motor. The fifth wheel is attached to the board near the longitudinal center of the board and extends through a slot in the board for coupling to the motor. The board is resilient and the diameter of the driven wheel is of such dimension in relation to the height of the board above the ground and of the trucks that support the board, and in relation to the resiliency of the board and the height of its attachment to the board that drive wheel does not contact the ground to drive the board unless the weight of a person on the board is distributed toward the longitudinal center of the board so as to flex the longitudinal center of the board toward the ground.

8 Claims, 3 Drawing Figures

MOTORIZED SKATEBOARD

BACKGROUND OF THE INVENTION

The present invention generally pertains to motorized skateboards and is particularly directed to an improvement in the construction of motorized skateboards.

A motorized skateboard basically includes an elongated board, a pair of trucks (four wheels) attached to the board under opposite end portions of the board for supporting the board above the ground, a motor and a chain/sprocket mechanism coupled to the motor for driving one or more of the four wheels and thus the board in response to the operation of the motor. Typically the board is resilient and of sufficient dimension and strength to support a person riding on the board. Board materials include wood, plastic, aluminum alloy, and fiberglass.

Typically, the motor has been attached to the truck at the rear end of the skateboard and is coupled to one of the rear skateboard wheels through a clutch mechanism so that power can be disengaged when it is not desired to drive the board. In other models, the drive wheel, one of the four wheels, is directly driven by the motor; but the motor is then restricted to low compression, small displacement engines which have to be push started; since there is no way to remove the driven wheel from the ground.

SUMMARY OF THE INVENTION

The motorized skateboard of the present invention is characterized by a fifth wheel drive being attached to the board near the longitudinal center of the board, and having a diameter of such dimension in relation to the dimension of the board and of the trucks and in relation to resiliency of the board that the drive wheel does not contact the ground to drive the board unless the weight of a person on the board is distributed toward the longitudinal center of the board, so as to flex the longitudinal center of the board toward the ground.

Preferably the motor also is positioned near the longitudinal center of the board and the board contains a slot near its longitudinal center, through which the fifth drive wheel extends for coupling to the motor above the board.

It also is preferred that the motor be permanently engaged to the drive wheel by a friction drive mechanism. Preferably the operation of the motor is controlled by the rider by means of a hand held motor control mechanism that is connected to the motor by a cable.

The motorized skateboard of the present invention represents an improvement over the prior art both in simplicity of construction and ease of operation. Also because the drive wheel is permanently engaged to the motor by a friction drive mechanism, the rider can use the drive wheel for compression braking by reducing the motor speed right down to the stall speed of the motor. Additionally, the drive wheel automatically lifts off the ground if the operator should step off the board, thereby providing run away protection.

The hand held motor control mechanism enables the rider to control the board without having to use his feet to control the speed and thereby allows the rider greater freedom of movement on and control over the board.

In addition, the combination of the hand held motor control mechanism together with the feature of being able to engage the drive wheel to the ground by distributing one's weight toward the longitudinal center of the board provides the rider with a jump start capability.

DESCRIPTION OF THE PREFERRED EMBODIMENT

Figure 1:
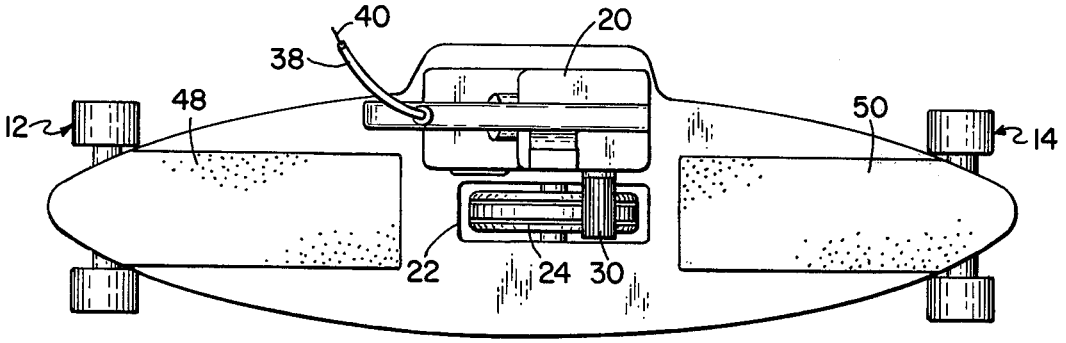
FIG. 1 is a top elevation partial plan view of the motorized skateboard of the present invention.

Referring to the drawings, the motorized skateboard of the present invention includes an elongated board 10, that is supported on trucks 12 and 14. The trucks 12 and 14 are attached to the board 10 under opposite end portions of the board 10 by means of wedge blocks 16 and 18 respectively.

The board 10 contains a slot 22 near the longitudinal center of the board 10. A fifth drive wheel 24 extends through the slot 22 and is journaled in trunion blocks 26 and 28, which are attached to the underside of the board 10. The rim of the fifth drive wheel 24 makes contact with a knurled drive pinion 30 that is fixed to the drive shaft 32 of the motor 20, and thereby in effect provides a friction drive mechanism for permanently engaging the drive wheel 24 to the motor 20.

The motor is controlled by a control mechanism 34. The control mechanism 34 is a brake type squeeze grip that is connected to a cable mechanism 36. The cable mechanism 36 includes a sheath 38 and a cable 40 within the sheath 38. The speed of the motor 20 is controlled with a trigger 42, such as commonly used on a chain saw motor or the like, which is suitable for such use. The trigger mechanism 42 is mounted in the motor frame 46. The sheath 38 is attached to the trigger 42 and the cable 40 is anchored to the frame 46. Accordingly the speed of the motor 20 is controlled by operating the squeeze grip mechanism 34.

The top surface of the board 10 includes non-skid treads 48 and 50, on which a rider may position his feet.

Figure 2:
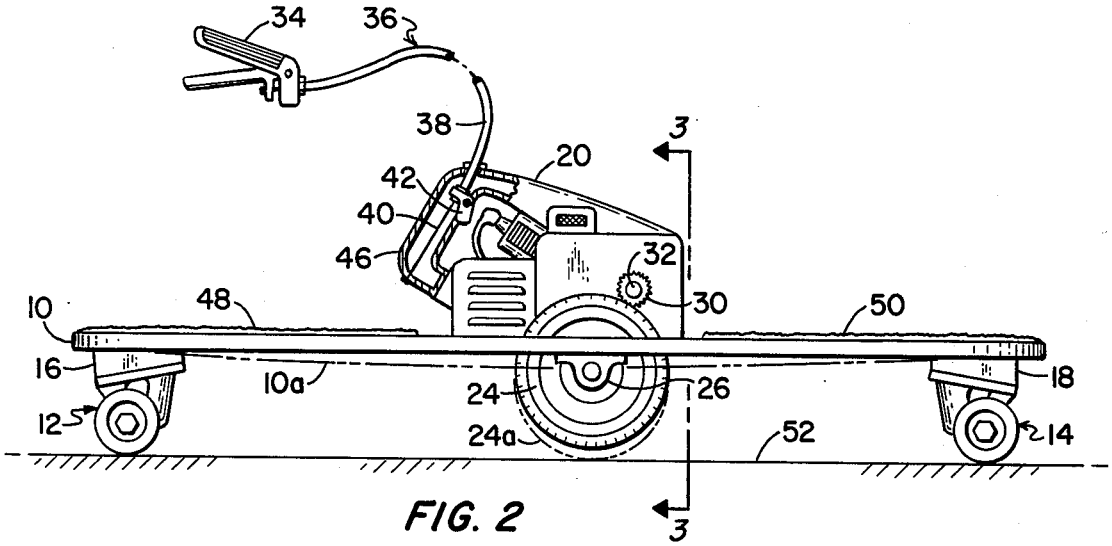
FIG. 2 is a side elevation plan view of the skateboard shown in FIG. 1.
Figure 3:
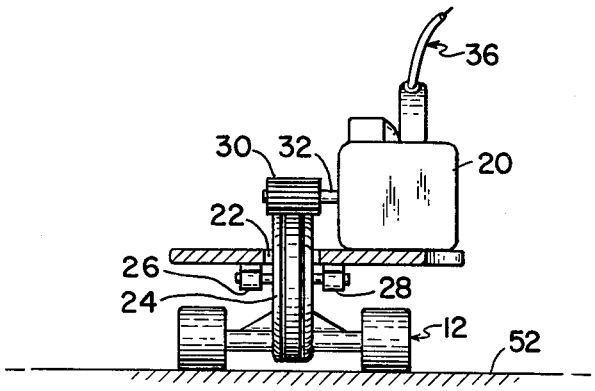
FIG. 3 is a sectional view of the skateboard as viewed along line 3—3 of FIG. 2.

The relative dimensions of the trucks 12 and 14 and the drive wheel 24, and the resiliency of the board 10 are such that when no rider is on the board, or when a rider on the board distributes his weight towards both ends of the board 10, the drive wheel 22 does not contact the ground 52. However, when the rider distributes his weight towards the longitudinal center of the board 10 so as to flex the longitudinal center of the board 10 toward the ground (as shown by broken line **10*a* in FIG. 2), the drive wheel 24 makes contact with the ground 52 (as shown by broken line 24*a*) so that the skateboard can be driven by the motor 20**.

The board 10 is made of an aluminum alloy, which provides the desired combination of resiliency and strength.

Having described my invention, I now claim.

1. In a motorized skateboard, comprising;

a resilient elongated board for supporting a person riding on the board;

a pair of trucks attached to the board under opposite end portions of the board for supporting the board above the ground; and a motor supported on the board; wherein the improvement comprises:

a fifth wheel drive means attached to the board and coupled to the motor for driving the board in response to operation of the motor;

the fifth wheel drive means including a drive wheel;

said drive wheel being attached to the board near the longitudinal center of the board, and having a diameter of such dimension in relation to the height of the board above the ground and of the trucks and in relation to resiliency of the board and the height of its attachment to the board that the drive wheel does not contact the ground to drive the board unless the weight of a person on the board is distributed toward the longitudinal center of the board so as to flex the longitudinal center of the board toward the ground.

2. A motorized skateboard according to claim 1, characterized by;

the motor being positioned near the longitudinal center of the board.

3. A motorized skateboard according to Claim 2, characterized by the board containing a slot near its longitudinal center, through which the drive wheel extends for coupling to the motor above the board.

4. A motorized skateboard according to claim 3, characterized by:

a friction drive means by which the motor is permanently engaged to the drive wheel.

5. A motorized skateboard according to claim 1, characterized by:

a friction drive means, by which the motor is permanently engaged to the drive wheel.

6. A motorized skateboard, according to claim 1, further comprising:

a hand held control means for controlling the motor; and characterized by a cable means connecting the control means to the motor for enabling the motor to be operated by hand by a rider on the board.

7. A motorized skateboard according to claim 6, characterized by:

the motor having a frame with a trigger means thereon for regulating the speed of the motor, the cable means including a sheath attached to the trigger means and a cable within the sheath anchored in relation to the frame; and the hand held control means including means attached to the sheath and cable for moving the sheath in relation to the cable.

8. A motorized skateboard according to claim 1, characterized by:

the board being made of an aluminum alloy.

* * * * *